US007070663B2

(12) United States Patent
Suzuki et al.

(10) Patent No.: US 7,070,663 B2
(45) Date of Patent: Jul. 4, 2006

(54) FERRITIC AND MARTENSITIC STAINLESS STEELS EXCELLENT IN MACHINABILITY

(75) Inventors: Satoshi Suzuki, Shunan (JP); Hideki Tanaka, Shunan (JP); Naoto Hiramatsu, Shunan (JP)

(73) Assignee: Nisshin Steel Co., Ltd., Tokyo (JP)

( * ) Notice: Subject to any disclaimer, the term of this patent is extended or adjusted under 35 U.S.C. 154(b) by 100 days.

(21) Appl. No.: 10/713,862

(22) Filed: Nov. 14, 2003

(65) Prior Publication Data

US 2004/0096351 A1 May 20, 2004

Related U.S. Application Data

(63) Continuation-in-part of application No. PCT/JP01/10084, filed on Nov. 19, 2001.

(30) Foreign Application Priority Data

Jun. 14, 2000 (JP) ..... 2000-177786
May 15, 2001 (JP) ..... 2001-145148
Jul. 5, 2001 (JP) ..... 2001-205349

(51) Int. Cl.
*C21D 8/00* (2006.01)
*C22C 38/20* (2006.01)

(52) U.S. Cl. ..... 148/326; 148/608; 420/60

(58) Field of Classification Search ..... 148/326, 148/332, 622–624, 607, 608, 325; 420/60
See application file for complete search history.

(56) References Cited

U.S. PATENT DOCUMENTS 5,362,337 A * 11/1994 Kosa ..... 148/325
5,496,421 A * 3/1996 Hashizume et al. ..... 148/326
5,861,068 A * 1/1999 Hasegawa et al. ..... 148/326

FOREIGN PATENT DOCUMENTS

JP 56-62902 A 5/1981
JP 09-170053 A 6/1997
JP 2000 8145 A 1/2000
JP 2000-63996 A 2/2000

* cited by examiner

*Primary Examiner*—Deborah Yee
(74) *Attorney, Agent, or Firm*—The Webb Law Firm

(57) ABSTRACT

A ferritic or martensitic stainless steel has the structure that Cu-enriched particles with concentration of C not less than 0.1 mass % or concentration of Sn and/or In not less than 10 mass % were dispersed in a matrix. Precipitation and dispersion of Cu-enriched particles is realized by aging the stainless steel at 500–900° C. for 1 hour or longer on any stage after a hot-rolling step until a forming step to a final product. The ferritic stainless steel contains 0.01–1.0% C, Si up to 1.0%, Mn up to 1.0%, 15–30% Cr, Ni up to 6.0% and 0.5–6.0% Cu. The martensitic stainless steel contains 0.01–0.5% C, Si up to 1.0%, Mn up to 1.0%, 10–15% Cr, Ni up to 6.0% and 0.5–6.0% Cu. Since Cu-enriched particles are dispersed for improvement of machinability instead of addition of S, Pb, Bi or Se, the stainless steel is machined to an objective shape without any harmful influence on workability, corrosion-resistance and the environment.

5 Claims, 1 Drawing Sheet

FERRITIC AND MARTENSITIC STAINLESS STEELS EXCELLENT IN MACHINABILITY

CROSS-REFERENCE TO RELATED APPLICATIONS

This application is a continuation-in-part of International Application No. PCT/JP01/10084, filed on Nov. 19, 2001, and designating, inter alia, the United States, which claims priority to Japanese Patent Application Serial Numbers 2000-177786, 2001-145148 and 2001-205349, filed Jun. 14, 2000, May 15, 2001 and Jul. 5, 2001, respectively.

BACKGROUND OF THE INVENTION

1. Field of the Invention

The present invention relates to ferritic and martensitic stainless steels having improved machinability by addition of nontoxic Cu.

2. Description of Related Art

Application of stainless steel to various industrial fields has been developed in response to remarkable progress of precision machinery industry and also gain of demand for electric home appliance, furniture and so on. In order to manufacture parts for such uses by automated machine tools with saving of labor, various proposals on improvement of machinability of stainless steels have been reported heretofore. For instance, machinability of ferritic stainless steel is improved by addition of Se as noted in SUS430F regulated under JIS4303. Machinability of martensitic stainless steel is improved by addition of Pb as noted in SUS410F and SUS410F2, or by addition of S as noted in SUS416 and SUS420F, each regulated under JIS4303.

However, the additive S substantially degrades hot-workability, ductility and corrosion-resistance and also causes anisotropy of mechanical property, although it is effective for machinability. Ferritic or martensitic stainless steel, which contains Pb for machinability, is un-recyclable due to unavoidable dissolution of toxic Pb during usage. Stainless steel 51430FSe regulated under SAE (corresponding to Type 430Se under AISI), which contains Se for machinability, actually causes environmental troubles due to toxicity of Se.

SUMMARY OF THE INVENTION

The present invention aims at provision of ferritic and martensitic stainless steels improved in machinability without any harmful influences on workability, corrosion-resistance, mechanical property and environments, by precipitation of Cu-enriched particles instead of conventional elements.

The present invention proposes ferritic and martensitic stainless steels in which Cu-enriched particles are dispersed at a ratio of 0.2 vol. % or more for improvement of machinability without any harmful influences on the environments. The Cu-enriched particles may be a phase containing C at a relatively high concentration of 0.1 mass % or more, or a phase containing Sn and/or In at a concentration of 10 mass % or more.

The ferritic stainless steel has a basic composition comprising 0.001–1 mass % of C, Si up to 1.0 mass %, Mn up to 1.0 mass %, 15–30 mass % of Cr, Ni up to 0.60 mass %, 0.5–6.0 mass % of Cu and the balance being Fe except inevitable impurities. The martensitic stainless steel has a basic composition comprising 0.01–0.5 mass % of C, Si up to 1.0 mass %, Mn up to 1.0 mass %, 10–15 mass % of Cr, Ni up to 0.60 mass %, 0.5–6.0 mass % of Cu and the balance being Fe except inevitable impurities.

In order to disperse precipitates of Cu-enriched particles with concentration of Sn or In not less than 10 mass %, the stainless steel is adjusted to a composition containing 0.005 mass % or more of Sn or In. Any of the ferritic and martensitic stainless steels may contain one or more of elements selected from 0.2–1.0 mass % of Nb, 0.02–1 mass % of Ti, 0–3 mass % of Mo, 0–1 mass % of Zr, 0–1 mass % of Al, 0–1 mass % of V, 0–0.05 mass % of B and 0–0.05 mass % of rare earth metals (REM).

Either of Cu-enriched particles with concentration of C not less than 0.1 mass % or Cu-enriched particles with concentration of Sn or In not less than 10 mass % is dispersed as precipitates in a ferritic or martensitic matrix by at least one-time aging treatment, whereby the ferritic or martensitic stainless steel is held 1 hour or longer at 500–900° C. on a stage after a hot-rolling step before a forming step to a final product.

DETAILED DESCRIPTION OF THE PREFERRED EMBODIMENTS

Figure 1:
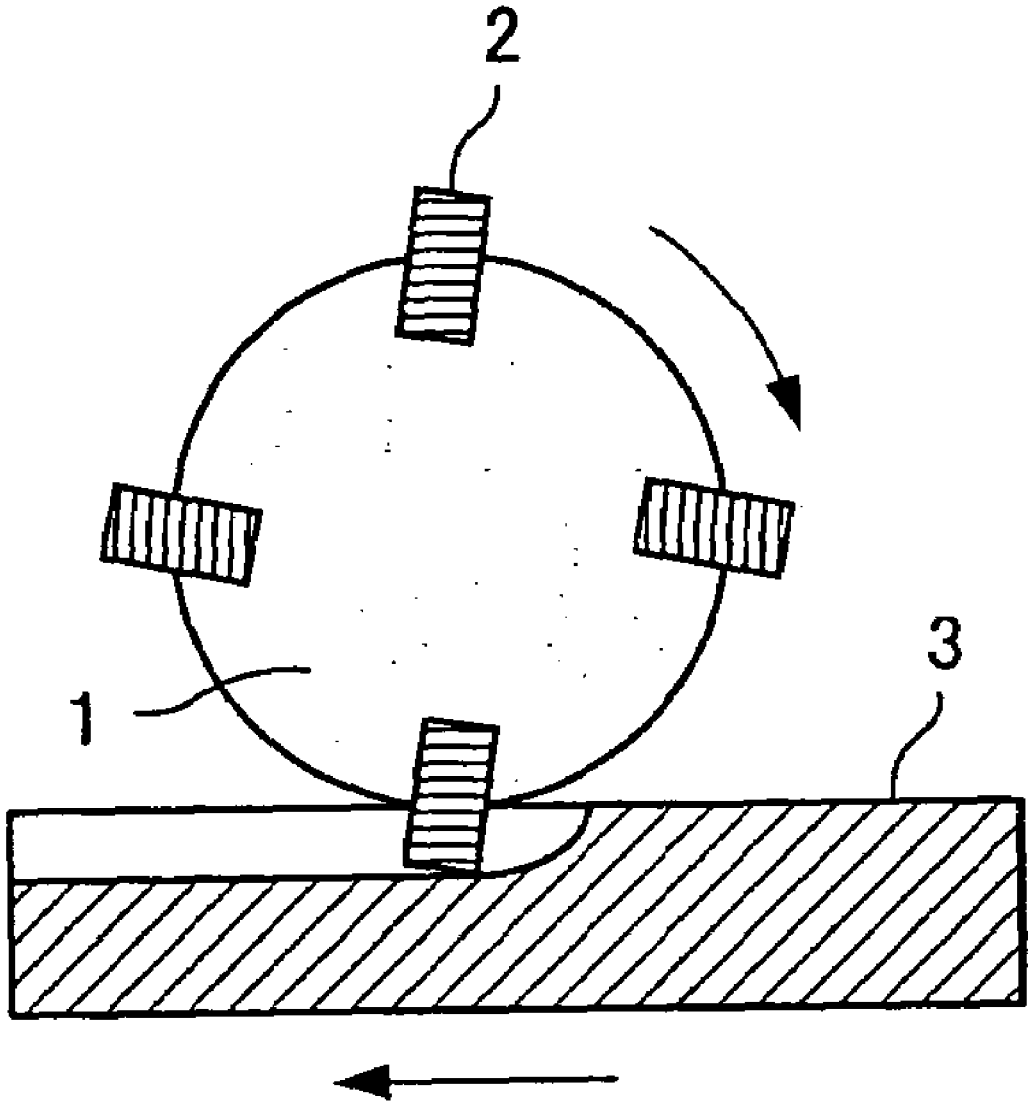
FIG. 1 is a view for explaining a test for evaluation of machinability.

Conventional stainless steel is poor of machinability in general and regarded as a representative unmachinable material. Poor machinability is caused by low thermal conductivity, work-hardenability and adhesiveness. The inventors have already reported that precipitation of Cu-enriched particles at a proper ratio effectively improves anti-microbial property and machinability of austenitic stainless steel without any harmful influences on the environments, in JP 2000-63996A. The inventors have further researched effects of Cu-enriched particles and hit upon that the effects on machinability are also realized ferritic and martensitic stainless steels.

Machinability of stainless steel is improved by fine precipitates of Cu-enriched phase, e.g. $\epsilon$-Cu, which lubricates between a steel material and a machining tool and promotes thermal flux, uniformly dispersed in a steel matrix. The effect of Cu-enriched phase on machinability is probably caused by its lubricating action and thermal conductivity to reduce abrasion at a rake face of the cutting tool. Reduction of abrasion leads up to decrease of machining resistance and also to prolongation of tool life.

Ferritic stainless steel or as-tempered martensitic stainless steel has crystalline structure of B.C.C. (body-centered-cubic), while Cu-enriched phase is F.C.C. (face-centered cubic). Precipitation of Cu-enriched phase in the B.C.C. matrix brings out bigger effect on improvement of machinability, as compared with precipitation of Cu-enriched phase in austenitic stainless steel having the same crystalline structure F.C.C.

The effect of Cu-enriched particles on ferritic or martensitic stainless steel different from that on austenitic stainless steel can be explained as follows: In the case where Cu-enriched precipitates (F.C.C.) are dispersed in a ferritic or martensitic matrix of B.C.C., crystallographical correspondency is disordered to a state capable of heavy stress accumulation by dispersion of Cu-enriched precipitates. Furthermore, an austenite former C is delivered from a steel matrix (B.C.C.) to Cu-enriched phase (F.C.C.), resulting in condensation of C in Cu-enriched phase and embrittlement of Cu-enriched phase. The brittle Cu-enriched particles, which act as starting points for destruction with dense accumulation of dislocations, are present as debris in the ferritic or martensitic matrix, so as to facilitate machining, i.e. a kind of fracture.

In the steel composition containing 0.005 mass % or more of Sn and/or In, Sn and/or In are condensed at a ratio of 10 mass % or more in Cu-enriched particles and converted to a low-melting Cu—Sn or Cu—In alloy. In short, low-melting Cu-enriched particles are dispersed as debris with big accumulation of dislocations, so as to promote lubrication between a steel material and a machining tool, resulting in remarkable prolongation of tool life.

Precipitation of Cu-enriched phase is realized by isothermal treatment such as aging within a proper temperature range or by gradually cooling the steel material over a possible-longest period within a temperature zone for precipitation in a temperature-falling step after heat-treatment. The inventors have confirmed from a plenty of research results on precipitation of Cu-enriched phase that aging treatment at 500–900° C. after final-annealing accelerates precipitation of Cu-enriched phase with condensation of C not less than 0.1 mass % or with condensation of Sn and/or In not less than 10 mass %. Precipitation of Cu-enriched phase also imparts anti-microbial property to the ferritic or martensitic stainless steel.

Precipitation of Cu-enriched phase may be accelerated by addition of at least one carbonitride- or precipitate-forming element such as Nb, Ti or Mo. Carbonitrides of these elements serve as precipitation site to uniformly disperse Cu-enriched particles in the ferritic or martensitic matrix with good productivity.

Each alloying component is added to stainless steel at a controlled ratio, as follows:

0.001–0.1 mass % of C for a ferritic stainless steel, or 0.01–0.5 mass % of C for a martensitic stainless steel C is condensed in Cu-enriched phase for embrittlement of Cu-enriched phase, and partially converted to chromium carbide, which act as precipitation site for Cu-enriched phase so as to uniformly distribute fine Cu-enriched particles in a steel matrix. The effect is typically noted at C content of 0.001 mass % or more in the ferritic stainless steel or at C content of 0.01 mass % or more in the martensitic stainless steel. However, excess C degrades productivity and corrosion-resistance of steel, so that an upper limit of C content is determined at 0.1 mass % for the ferritic stainless steel or at 0.5 mass % for the martensitic stainless steel.

Si Up to 1.0 Mass %

Si is an element for improvement of corrosion-resistance and anti-microbial property. However, excess Si content above 1.0 mass % degrades productivity of steel.

Mn Up to 1.0 Mass %

Mn is an element for improvement of productivity and stabilizes harmful S as MnS in a steel matrix. The intermetallic compound MnS improves machinability of steel and also serves as a site for precipitation of fine Cu-enriched particles. However, excess Mn above 1.0 mass % degrades corrosion-resistance of steel.

S Up to 0.3 Mass %

Although S is an element, which is converted to MnS effective on machinability, hot-workability and ductility of a stainless steel are degraded as increase of S content. In this sense, an upper limit of S content is determined at 0.3 mass %.

10–30 mass % of Cr for a ferritic stainless steel

10–15 mass % of Cr for a martensitic stainless steel

Cr is an essential element for corrosion-resistance of a stainless steel. Addition of Cr at a ratio more than 10 mass % is necessary to ensure corrosion-resistance. However, excess Cr above 30 mass % degrades productivity and workability of a ferritic stainless steel, or excess Cr above 15 mass % makes a ferritic phase too stable to induce martensitic transformation in an annealed state.

Ni Up to 0.60 Mass %

Ni is an inevitable impurity included from raw materials, in a conventional process for manufacturing ferritic or martensitic stainless steels. An upper limit of Ni content is determined at a level of 0.60 mass %.

0.5–6.0 Mass % of Cu

Cu is an important element in the inventive stainless steel. Precipitation of Cu-enriched particles in a steel matrix at a ratio of 0.2 vol. % or more is necessary for realization of good machinability. In this sense, Cu content is determined at 0.5 mass % or more in order to precipitate Cu-enriched particles at a ratio not-less than 0.2 vol. % in the ferritic or martensitic stainless steel having the specified composition. However, excess Cu above 6.0 mass % degrades productivity, workability and corrosion-resistance of the stainless steels. There are no restrictions on size of Cu-enriched particles precipitated in the ferritic or martensitic matrix, but it is preferable to uniformly disperse Cu-enriched particles throughout the matrix including a surface layer. Uniform dispersion of Cu-enriched particles improves machinability of the stainless steels to a highly-stable level and also bestows the stainless steels with anti-microbial property.

0.005 Mass % or More of Sn and/or In

Sn and/or In are alloying elements necessary for precipitation of Cu-enriched particles, in which Sn and/or In are condensed. A melting temperature of Cu-enriched phase falls down as condensation of Sn and/or In at a ratio not less than 10 mass %, resulting in remarkable improvement of machinability. A ratio of Sn and/or In in the stainless steel is controlled to 0.005 mass % or more for falling a melting temperature of Cu-enriched phase. When both Sn and In are added to steel, a total ratio of Sn and In is determined at 0.005 mass % or more. However, excessive addition of Sn and/or In lowers a meting-temperature of Cu-enriched phase to a great extent, so that hot-workability of steel is drastically worsened due to liquid-phase embrittlement. In this sense, an upper limit of Sn and/or In content is preferably determined at 0.5 mass %.

0.02–1 Mass % of Nb

Nb is an optional element. Among various precipitates, Nb precipitate is a most-effective site for precipitation of Cu-enriched particles. The metallurgical structure, wherein fine precipitates such as niobium carbide, nitride and carbonitride are uniformly dispersed, is suitable for uniform precipitation of Cu-enriched particles. However, excess Nb degrades productivity and workability of the stainless steel. In this sense, Nb is preferably added at a ratio within a range of 0.02–1 mass %.

0.02–1 Mass % of Ti

Ti is also an optional element for generation of titanium carbonitride, which serves as a site for precipitation of Cu-enriched particles, as the same as Nb. However, excess Ti degrades productivity and workability and also causes occurrence of scratches on a surface of a steel sheet. Therefore, Ti is preferably added at a ratio within a range of 0.02–1 mass %, if necessary.

0–3 Mass % of Mo

Mo is an optional element for corrosion-resistance. Mo is partially precipitated as intermetallic compounds such as $Fe_2Mo$, which serve as sites for precipitation of fine Cu-enriched particles. However, excess Mo above 3 mass % degrades productivity and workability of the stainless steel.

0–1 Mass % of Zr

Zr is an optional element, which precipitates as carbonitride effective for precipitation of fine Cu-enriched particles. However, excess Zr above 1 mass % degrades productivity and workability of the stainless steel.

0–1 Mass % of Al

Al is an optional element for improvement of corrosion-resistance as the same as Mo, and partially precipitated as compounds, which serve as sites for precipitation of Cu-enriched particles. However, excess Al above 1 mass % degrades productivity and workability of the stainless steel.

0–1 Mass % of V

V is an optional element, and partially precipitated as carbonitride, which serve as a site for precipitation of fine Cu-enriched particles, as the same as Zr. However, excess V above 1 mass % degrades productivity and workability of the stainless steel.

0–0.05 Mass % of B

B is an optional element for improvement of hot-workability and dispersed as fine precipitates in a steel matrix. The boron precipitates also serve as sites for precipitation of Cu-enriched particles. However, excess B causes degradation of hot-workability, so that an upper limit of B content is determined at 0.05 mass %.

0–0.05 Mass % of Rare Earth Metals (REM)

REM is an optional element, too. Hot-workability of the stainless steel is improved by addition of REM at a proper ratio as the same as B. REM is also dispersed as fine precipitates, which serve as sites for precipitation of Cu-enriched particles. However, excess REM above 0.05 mass % degrades hot-workability of the stainless steel.

Heat-Treatment at 500–900° C.

A stainless steel is advantageously aged at 500–900° C. in order to precipitate Cu-enriched particles effective for machinability. As an aging temperature is lower, solubility of Cu in a steel matrix is reduced, resulting in an increase of Cu-enriched particles. However, a ratio of Cu-enriched particles precipitated in the steel matrix is rather reduced at a too-lower aging temperature due to slow diffusion rate. The inventors have confirmed from various experiments that a proper temperature range for aging treatment is 500–900° C. for precipitation of Cu-enriched particles at a ratio not less than 0.2 vol. % suitable for improvement of machinability. The aging treatment may be performed on any stage after a hot-rolling step before a final step to form a product shape, but it shall be continued one hour or longer at the specified temperature.

The other features of the present invention will be more clearly understood from the following Examples.

EXAMPLE 1

Several ferritic stainless steels with chemical compositions shown in Table 1 were melted in a 30 kg-vacuum melting furnace, cast to slabs and forged to steel rods of 50 mm in diameter. Each steel rod was annealed 30 minutes at 1000° C. and aged at a temperature varied within a range of 450–950° C.

TABLE 1

Chemical Compositions of Ferritic Stainless Steels

| Steel | Alloying elements (mass %) | | | | | | | |
|---|---|---|---|---|---|---|---|---|
| Kind | C | Si | Mn | S | Ni | Cr | Cu | Others |
| A | 0.054 | 0.56 | 0.34 | 0.002 | 0.23 | 16.25 | 2.02 | — |
| B | 0.061 | 0.62 | 0.22 | 0.003 | 0.34 | 16.49 | 1.48 | — |
| C | 0.049 | 0.43 | 0.31 | 0.004 | 0.25 | 16.21 | 1.09 | — |
| D | 0.055 | 0.51 | 0.41 | 0.005 | 0.21 | 16.19 | 0.40 | — |
| E | 0.063 | 0.39 | 0.19 | 0.202 | 0.28 | 16.25 | 0.48 | — |
| F | 0.059 | 0.44 | 0.42 | 0.002 | 0.33 | 16.38 | 0.51 | — |
| G | 0.009 | 0.31 | 0.2 | 0.005 | 0.26 | 17.02 | 1.46 | Nb: 0.36 |
| H | 0.011 | 0.42 | 0.23 | 0.003 | 0.38 | 17.11 | 0.32 | Nb: 0.33 |
| I | 0.021 | 0.41 | 0.23 | 0.007 | 0.42 | 16.53 | 2.43 | Ti: 0.35 |
| J | 0.019 | 0.35 | 0.31 | 0.004 | 0.28 | 16.42 | 0.48 | Ti: 0.34 |
| K | 0.061 | 0.55 | 0.42 | 0.004 | 0.12 | 16.31 | 1.34 | Al: 0.07 |
| L | 0.019 | 0.38 | 0.33 | 0.005 | 0.39 | 16.21 | 1.61 | Zr: 0.88 |
| M | 0.024 | 0.56 | 0.18 | 0.002 | 0.29 | 17.12 | 1.89 | V: 0.82 |
| N | 0.055 | 0.33 | 0.51 | 0.001 | 0.39 | 16.54 | 1.72 | B: 0.006 |
| O | 0.051 | 0.42 | 0.18 | 0.003 | 0.26 | 17.21 | 2.33 | REM: 0.02 |
| P | 0.0008 | 0.33 | 0.21 | 0.003 | 0.31 | 17.41 | 1.33 | — |

A test piece sampled from each steel rod was subjected to a machining test regulated under JIS B-4011 entitled "a method of machining test with a hard alloy bit". In the machining test, abrasion of the bit was evaluated on the basis of flank wear ($V_B$=0.3 mm) under conditions of a feed rate of 0.05 mm/pass, a cutting depth of 0.3 mm/pass and a length of cut of 200 mm.

Another test piece sampled from the same steel rod was observed by, a transmission electron microscopy (TEM), and Cu-enriched particles dispersed in a ferrite matrix was quantitatively analyzed by an image processor to calculate a ratio (vol. %) of the Cu-enriched particles. Furthermore, concentration of C in the Cu-enriched particles was measured by Energy Dispersed X-ray Analysis (EDX).

A wear-out period of each of test pieces, which were sampled from Steels A-1 to P-1 aged 9 hours at 800° C., was compared with a wear-out period $V_B$ of Steel D-1 as a reference value. Machinability of each test piece was evaluated in comparison with Steel E-1, which has been regarded heretofore as material good of machinability. The mark ◎ means machinability better than Steel E-1, the mark ○ means machinability similar to Steel E-1, and the mark X means machinability poor than Steel E-1. Results of machinability are shown in Table 2.

Any of the test steels A-1, B-1, C-1, F-1, G-1, I-1 and K-1, which contained not less than 0.5 mass % of Cu and had the structure that Cu-enriched particles with concentration of C not less than 0.1 mass % were dispersed in a ferrite matrix at a ratio of 0.2 vol. % or more by aging-treatment, was excellent in machinability.

On the other hand, Steels A-2, B-2, C-2 and F-2, which were not subjected to aging treatment, had Cu-enriched particles dispersed at an insufficient ratio less than 0.2 vol. % regardless Cu content more than 0.5 mass %, resulting in poor machinability. Steel J-2 was poor of machinability due to shortage of Cu for dispersion of Cu-enriched particles at a ratio of 0.2 vol. % or more even after aging treatment. Steel P-1 did not exhibit well machinability due to poor embrittlement of Cu-enriched particles, since concentration of C in the Cu-enriched particles was less than 0.001 mass %, although it contained Cu more than 0.5 mass % and had Cu-enriched particles dispersed at a ratio more than 0.2 vol. %.

TABLE 2

Effects of Cu-Enriched Particles on Machinability

| Steel Kind | Aging | Cu-enriched particles: Precipitation ratio (vol. %) | Cu-enriched particles: Concentration (mass %) of C | Wear-out period (minutes) of bits | Machinability | Note |
|---|---|---|---|---|---|---|
| A-1 | done | 0.48 | 0.13 | 189 | ◎ | Inventive Example |
| A-2 | none | 0.18 | 0.05 | 105 | X | Comparative Example |
| B-1 | done | 0.44 | 0.15 | 185 | ◎ | Inventive Example |
| B-2 | none | 0.15 | 0.03 | 110 | X | Comparative Example |
| C-1 | done | 0.38 | 0.22 | 178 | ◎ | Inventive Example |
| C-2 | none | 0.08 | 0.02 | 98 | X | Comparative Example |
| D-1 | none | 0.00 | — | 100 | — | " |
| E-1 | none | 0.00 | — | 175 | ◎ | Prior Art |
| F-1 | done | 0.20 | 0.31 | 177 | ◎ | Inventive Example |
| F-2 | nonee | 0.02 | 0.04 | 123 | X | Comparative Example |
| G-1 | done | 0.42 | 0.14 | 192 | ◎ | Inventive Example |
| H-1 | done | 0.00 | — | 95 | X | Comparative Example |
| I-1 | done | 0.51 | 0.12 | 188 | ◎ | Inventive Example |
| J-1 | none | 0.00 | — | 99 | X | Comparative Example |
| J-2 | done | 0.18 | 0.28 | 131 | X | " |
| K-1 | done | 0.34 | 0.15 | 177 | ◎ | Inventive Example |
| L-1 | done | 0.38 | 0.21 | 185 | ◎ | " |
| M-1 | done | 0.40 | 0.15 | 192 | ◎ | " |
| N-1 | done | 0.41 | 0.17 | 195 | ◎ | " |
| O-1 | done | 0.44 | 0.13 | 183 | ◎ | " |
| P-1 | done | 0.34 | 0.04 | 123 | X | Comparative Example |

Aging treatment: 9 hours at 800° C.

EXAMPLE 2

Test pieces were sampled from Steel A in Table 1 under the same conditions as Example 1. Test pieces were individually subjected to aging treatment under conditions varied within ranges of 450–950° C. and 0.5–12 hours. Machinability of each aged test piece was evaluated in the same way as Example 1.

It is understood from results shown in Table 3 that any of test pieces A-4 and A-6 to A-10, which was aged one hour or longer at 500–900° C., had Cu-enriched particles with concentration of C of 0.1 mass % or more dispersed in a ferrite matrix at a ratio of 0.2 vol. % or more, resulting in good machinability.

On the other hand, Steel A-5, which had been aged at a temperature within a range of 500–900° C. but for a period shorter than 1 hour, was poor of machinability due to the structure that Cu-enriched particles with concentration of C not less than 0.1 mass % were insufficiently dispersed at a ratio less than 0.2 vol. %. A precipitation ratio of Cu-enriched particles was also less than 0.2 vol. % at an aging temperature lower than 500° C. or higher than 900° C.

The results prove that important factors for improvement of machinability are Cu content of 0.5 mass % or more in a ferritic steel and Cu-enriched particles with concentration of C not less than 0.1 mass % dispersed at a ratio of 0.2 vol. % or more in a ferrite matrix, and that the proper precipitation ratio of Cu-enriched particles is realized by aging the stainless steel at 500–900° C. for one hour or longer.

TABLE 3

Relationship of Aging Conditions with Precipitation of Cu-enriched Particles and Machinability

| Steel Kind | Aging conditions: Temperature (° C.) | Aging conditions: Heating hours | Cu-enriched Particles: Precipitation ratio (vol. %) | Cu-enriched Particles: Concentration of C (mass %) | Wear-out period (minutes) of bits | Machinability | Note |
|---|---|---|---|---|---|---|---|
| A-3 | 450 | 6 | 0.11 | 0.03 | 125 | X | Comparative Example |
| A-4 | 500 | 6 | 0.34 | 0.23 | 177 | ◎ | Inventive Example |
| A-5 | 500 | 0.5 | 0.18 | 0.05 | 131 | X | Comparative Example |
| A-6 | 500 | 1 | 0.21 | 0.18 | 176 | ◎ | Inventive Example |
| A-7 | 600 | 9 | 0.39 | 0.16 | 181 | ◎ | " |
| A-8 | 700 | 12 | 0.42 | 0.14 | 192 | ◎ | " |
| A-9 | 800 | 9 | 0.44 | 0.15 | 200 | ◎ | " |
| A-10 | 900 | 10 | 0.45 | 0.17 | 202 | ◎ | " |
| A-11 | 950 | 9 | 0.19 | 0.05 | 127 | X | Comparative Example |

EXAMPLE 3

Several martensite stainless steels which chemical compositions shown in Table 4 were melted in a 30kg-vacuum melting furnace, cast to slabs, forged to steels rod of 50 mm in diameter. Each steel rod was annealed 30 minutes at 1000° C., and some steel rods were aged at a temperature varied within a range of 450–950° C.

TABLE 4

Chemical Compositions of Martensitic Stainless Steels

| Steel | Alloying Elements (mass %) | | | | | | | |
|---|---|---|---|---|---|---|---|---|
| Kind | C | Si | Mn | S | Ni | Cr | Cu | Others |
| MA | 0.092 | 0.23 | 0.77 | 0.003 | 0.23 | 11.55 | 4.51 | — |
| MB | 0.102 | 0.31 | 0.62 | 0.003 | 0.34 | 11.31 | 3.22 | — |
| MC | 0.099 | 0.35 | 0.52 | 0.004 | 0.21 | 11.45 | 1.53 | — |
| ME | 0.063 | 0.39 | 0.44 | 0.213 | 0.45 | 12.42 | 0.48 | — |
| MF | 0.35 | 0.44 | 0.42 | 0.002 | 0.33 | 11.67 | 0.82 | — |
| MG | 0.102 | 0.31 | 0.2 | 0.005 | 0.26 | 13.21 | 1.46 | Nb : 0.38 |
| MH | 0.142 | 0.42 | 0.23 | 0.003 | 0.38 | 12.98 | 0.32 | Nb: 0.31 |
| MI | 0.053 | 0.41 | 0.23 | 0.007 | 0.42 | 14.12 | 2.43 | Ti: 0.33 |
| MJ | 0.103 | 0.35 | 0.31 | 0.004 | 0.28 | 11.23 | 0.48 | Ti: 0.34 |
| MK | 0.202 | 0.55 | 0.42 | 0.004 | 0.12 | 13.67 | 1.21 | Al: 0.06 |
| ML | 0.019 | 0.38 | 0.33 | 0.005 | 0.39 | 10.76 | 1.77 | Zr: 0.88 |
| MM | 0.103 | 0.56 | 0.18 | 0.002 | 0.29 | 14.21 | 2.01 | V: 0.82 |
| MN | 0.082 | 0.33 | 0.51 | 0.001 | 0.39 | 11.23 | 1.72 | B: 0.006 |
| MO | 0.156 | 0.42 | 0.18 | 0.003 | 0.26 | 14.21 | 2.33 | REM: 0.02 |
| MP | 0.007 | 0.33 | 0.21 | 0.003 | 0.31 | 13.21 | 1.33 | — |

Test pieces sampled from each steel rod were subjected to the same tests as Example 1, for measuring a precipitation ratio of Cu-enriched particles, concentration of C in the Cu-enriched particles and a wear-out period of bit.

ME-1, the mark ○ means, machinability similar to Steel ME-1, and the mark X means inferior machinability to Steel ME-1. Results of machinability are shown in Table 5.

Any of the test steels MA-1, MB-1, MC-1, MF-1, MG -1, MI-1, MK-1, ML-1, MM-1, MN-1 and MO-1, which contained Cu of 0.5 mass % or more and had the structure that Cu-enriched particles with concentration of Cu not less than 0.1 mass % were dispersed in a steel matrix at a ratio of 0.1 vol. % or more by aging-treatment, was excellent in machinability.

On the other hand, Steels MA-2, MB-2, MC-2 and MF-2, which were not subjected to aging treatment, had Cu-enriched particles dispersed at an insufficient ratio less than 0.2 vol. % regardless Cu content more than 0.5 mass %, resulting in poor machinability. Steel MJ-2 was poor of machinability due to shortage of Cu for dispersion of Cu-enriched particles at a ratio of 0.2 vol. % or more even after aging treatment. Steel MP-1 did not exhibit well machinability due to poor embrittlement of Cu-enriched particles, since concentration of C in the Cu-enriched particles was less than 0.001 mass %, although it contained Cu more than 0.5 mass % and had Cu-enriched particles dispersed at a ratio more than 0.2 vol. %.

TABLE 5

Effects of Cu-Enriched Particles on Machinability

| Steel Kind | Aging | Cu-enriched particles: Precipitation ratio (vol. %) | Cu-enriched particles: Concentration (mass %) of C | Wear-out period (minutes) of bits | Machinability | Note |
|---|---|---|---|---|---|---|
| MA-1 | Done | 0.89 | 0.22 | 201 | ◎ | Inventive Example |
| MA-2 | None | 0.19 | 0.23 | 105 | X | Comparative Example |
| MB-1 | Done | 0.54 | 0.54 | 222 | ◎ | Inventive Example |
| MB-2 | none | 0.11 | 0.15 | 109 | X | Comparative Example |
| MC-1 | done | 0.42 | 0.32 | 192 | ◎ | Inventive Example |
| MC-2 | none | 0.13 | 0.08 | 98 | X | Comparative Example |
| ME-1 | done | 0.16 | 0.18 | 120 | ○ | Comparative Example |
| ME-2 | none | 0.02 | 0.01 | 103 | X | Prior Art |
| MF-1 | done | 0.24 | 0.56 | 172 | ◎ | Inventive Example |
| MF-2 | none | 0.09 | 0.34 | 99 | X | Comparative Example |
| MG-1 | done | 0.53 | 0.78 | 204 | ◎ | Inventive Example |
| MH-1 | done | 0.02 | 0.23 | 95 | X | " |
| MI-1 | done | 0.51 | 0.65 | 210 | ◎ | " |
| MJ-1 | none | 0.08 | 0.33 | 110 | X | Comparative Example |
| MJ-2 | done | 0.11 | 0.72 | 114 | X | " |
| MK-1 | done | 0.34 | 0.34 | 222 | ◎ | Inventive Example |
| ML-1 | done | 0.67 | 0.89 | 198 | ◎ | " |
| MM-1 | done | 0.82 | 0.64 | 205 | ◎ | " |
| MN-1 | done | 0.55 | 0.59 | 201 | ◎ | " |
| MO-1 | done | 0.39 | 0.88 | 222 | ◎ | " |
| MP-1 | done | 0.45 | 0.08 | 112 | X | Comparative Example |

Aging treatment: 9 hours at 780° C.
Aging treatment: 9 hours at 800° C.

A wear-out period of each of test pieces, which were sampled from Steels MA-1 to MP-1 aged 9 hours at 780° C., was compared with a wear-out period $V_B$ of Steel ME-1, which has been regarded heretofore as material good of machinability, as a reference value. Machinability of each test piece was evaluated in comparison with the same Steel ME-1. The mark ◎ means machinability better than Steel

EXAMPLE 4

Test pieces were sampled from Steel MA in Table 4 under the same conditions as Example 3. Test pieces were individually subjected to aging treatment under conditions varied within ranges of 450–950° C. and 0.5–12 hours. Machinability of each aged test piece was evaluated in the same way as Example 1.

It is understood from results shown in Table 6 that any of test pieces MA-4 and MA-6 to MA-10, which was aged one hour or longer at 500–900° C., had Cu-enriched particles with concentration of C of 0.1 mass % or more dispersed in a steel matrix at a ratio of 0.2 vol. % or more, resulting in good machinability.

On the other hand, Steel MA-5, which was aged at a temperature within a range of 500–900° C. but for a period shorter than one hour, was poor of machinability due to the structure that Cu-enriched particles with concentration of C not less than 0.1 mass % were insufficiently dispersed at a ratio less than 0.2 vol. %. A precipitation ratio of Cu-enriched particles was also less than 0.2 vol. % at an aging temperature lower than 500° C. or higher than 900° C.

The results prove that important factors for improvement of machinability are Cu content of 0.5 mass % or more in a martensitic steel and a ratio of Cu-enriched particles with concentration of C not less than 0.1 mass % dispersed at a ratio of 0.2 vol. % or more in a steel matrix, and that the proper precipitation ratio of Cu-enriched particles is realized by aging the stainless steel at 500–900° C. for one hour or longer.

TABLE 6

Relationship of Aging Conditions with Precipitation of Cu-enriched Particles and Machinability

| Steel Kind | Aging conditions: Temperature (° C.) | Aging conditions: Heating hours | Cu-enriched Particles: Precipitation ratio (vol. %) | Cu-enriched Particles: Concentration of C (mass %) | Wear-out period (minutes) of bits | Machinability | Note |
|---|---|---|---|---|---|---|---|
| MA-3 | 450 | 12 | 0.18 | 0.09 | 109 | X | Comparative Example |
| MA-4 | 500 | 6 | 0.56 | 0.34 | 192 | ◎ | Inventive Example |
| MA-5 | 500 | 0.8 | 0.15 | 0.06 | 118 | X | Comparative Example |
| MA-6 | 500 | 2 | 0.24 | 0.13 | 189 | ◎ | Inventive Example |
| MA-7 | 600 | 10 | 0.65 | 0.45 | 203 | ◎ | " |
| MA-8 | 700 | 12 | 0.82 | 0.67 | 192 | ◎ | " |
| MA-9 | 800 | 8 | 0.92 | 0.82 | 245 | ◎ | " |
| MA-10 | 900 | 9 | 0.67 | 0.92 | 234 | ◎ | " |
| A-11 | 950 | 9 | 0.17 | 0.08 | 110 | X | Comparative Example |

EXAMPLE 5

Several martensite stainless steels with chemical compositions shown in Table 7 were melted in a 30 kg-vacuum melting furnace, cast to slabs, heated one hour at 1230° C., hot-rolled to thickness of 4 mm, aged at various temperatures and then pickled.

TABLE 7

Chemical Compositions of Martensitic Stainless Steels

| Steel Kind | Alloying Elements (mass %): C | Si | Mn | S | Ni | Cr | Cu | Sn | Others |
|---|---|---|---|---|---|---|---|---|---|
| MA | 0.061 | 0.31 | 0.81 | 0.005 | 0.12 | 11.62 | 3.01 | 0.004 | |
| MB | 0.058 | 0.33 | 0.77 | 0.002 | 0.33 | 11.24 | 2.98 | 0.006 | |
| MC | 0.059 | 0.28 | 0.34 | 0.012 | 0.18 | 11.98 | 3.21 | 0.212 | |
| MD | 0.066 | 0.41 | 0.64 | 0.001 | 0.21 | 12.43 | 1.53 | 0.487 | |
| MF | 0.102 | 0.29 | 0.43 | 0.008 | 0.42 | 14.12 | 0.47 | 0.112 | |
| MG | 0.007 | 0.37 | 0.51 | 0.004 | 0.26 | 11.76 | 0.54 | 0.142 | |
| MH | 0.088 | 0.51 | 0.31 | 0.005 | 0.22 | 13.21 | 1.01 | 0.213 | |
| MI | 0.052 | 0.34 | 0.62 | 0.012 | 0.44 | 12.02 | 4.03 | 0.081 | |
| MJ | 0.088 | 0.51 | 0.31 | 0.089 | 0.22 | 13.21 | 1.01 | 0.213 | |
| MK | 0.051 | 0.33 | 0.83 | 0.143 | 0.34 | 11.76 | 1.32 | 0.241 | |
| ML | 0.102 | 0.28 | 0.92 | 0.152 | 0.28 | 11.22 | 1.28 | 0.198 | |
| MM | 0.152 | 0.87 | 0.43 | 0.008 | 0.60 | 10.91 | 0.88 | 0.081 | Nb: 0.36 |
| MN | 0.008 | 0.12 | 0.88 | 0.012 | 0.22 | 13.09 | 1.23 | 0.092 | Ti: 0.35 |
| MO | 0.043 | 0.08 | 0.97 | 0.014 | 0.09 | 12.55 | 5.21 | 0.002 | In: 0.082 |
| MP | 0.002 | 0.98 | 0.24 | 0.092 | 0.18 | 12.12 | 1.98 | 0.152 | Al: 0.07 |
| MQ | 0.021 | 0.44 | 0.12 | 0.082 | 0.43 | 12.38 | 4.12 | 0.443 | Zr: 0.88 |
| MR | 0.123 | 0.42 | 0.18 | 0.003 | 0.26 | 12.21 | 2.33 | 0.289 | V: 0.82 |
| MS | 0.089 | 0.33 | 0.21 | 0.003 | 0.31 | 12.41 | 1.21 | 0.181 | B: 0.006 |
| MT | 0.063 | 0.42 | 0.47 | 0.251 | 0.51 | 12.76 | 0.32 | 0.001 | |

Each steel sheet was subjected to a machining test with a horizontal milling machine regulated by JIS B4107, wherein 16 pieces of hard alloy bits 2 were attached to a miller 1 of 125 mm in outer diameter and 10 mm in width along a circumferential direction, and a test piece 3 was machined along a direction perpendicular to a rolling direction without use of a lubricant under conditions of a rotational speed of 2000 r.p.m., a feed rate of 0.6 mm/pass and a cutting depth of 0.5 mm/pass, as shown in FIG. 1.

After the steel sheet was continuously machined by length of 1200 mm along its longitudinal direction, it was shifted by 10 mm along a traverse direction and machined again along its longitudinal direction at a position adjacent to the first machining position. A whole surface of the steel sheet was machined by depth of 0.5 mm by repetition of machining. Thereafter, the steel sheet was set at an original position and further machined by depth of 0.5 mm. The machining was repeated, and abrasion of the bits was evaluated by a machining period until the bits were worn out by 0.1 mm.

Another test piece sampled from the same steel sheet was observed by TEM, and Cu-enriched particles dispersed in a steel matrix was quantitatively analyzed by an image processor to calculate a ratio (vol. %) of the Cu-enriched particles. Furthermore, concentration of Sn or In in the Cu-enriched particles was measured by EDX.

Machinability of each test piece, which were sampled from Steels MA-1 to MS-1 aged 9 hours at 790° C., was compared with machinability of Steel MT-1, which has been regarded heretofore as material good of machinability. The mark ◎ means machinability better than Steel MT-1, the mark ○ means machinability similar to Steel MT-1, and the mark X means inferior machinability to Steel MT-1. Results of machinability are shown in Table 8.

Any of Steels MB-1, MC-1, MD-1, MG-1, MI-1, MJ-1, MK-1, MM-1, MN-1, MO-1, MP-1, MQ-1, MR-1 and MS-1, which contained Cu not less than 0.5 mass % and Sn (or In in Steel MO-1) not less than 0.005 mass % had the structure that Cu-enriched particles with concentration of Sn or In not less than 10 mass % were dispersed in a steel matrix at a ratio of 0.2 vol. % or more by aging-treatment, was excellent in machinability.

On the other hand, Steels MB-2, MC-2, MD-2, MF-2, MG-2, MI-2, MJ-2, MK-2, ML-2, MM-2, MN-2, MO-2, MP-2, MQ-2, MR-2 and MS-2, which were not subjected to aging treatment, had Cu-enriched particles dispersed at an insufficient ratio less than 0.2 vol. % regardless Cu content more than 0.5 mass %, resulting in poor machinability. Steels MF-1 and -2 were poor of machinability due to shortage of Cu for dispersion of Cu-enriched particles at a ratio of 0.2 vol. % or more after aging treatment. Steel MA-1 exhibited machinability better than Steel MT-1, but the machinability was insufficient due to shortage of Sn for concentration of Sn not less than 10 mass % in Cu-enriched particles. Steel ML-1, which contained Sn more than 0.15 mass %, was too poor of hot-workability to prepare a test piece for evaluation.

TABLE 8

Effects of Cu-enriched Particles on Machinability

| Steel | | Cu-enriched particles | | | | | |
|---|---|---|---|---|---|---|---|
| | | | Concentration (mass %) | | | | |
| Kind | Aging | Precipitation ratio (vol. %) | Sn | In | Worn-out period (minutes) of bits | Machinability | Note |
| MA-1 | done | 0.48 | 8.9 | — | 192 | ◎ | Prior Art |
| MA-2 | none | 0.18 | 8.2 | — | 105 | X | Comparative Example |
| MB-1 | done | 0.51 | 12.3 | — | 251 | ◎ | Inventive Example |
| MB-2 | none | 0.07 | 10.5 | — | 110 | X | Comparative Example |
| MC-1 | done | 0.44 | 63.1 | — | 487 | ◎ | Inventive Example |
| MC-2 | none | 0.08 | 55.3 | — | 98 | X | Comparative Example |
| MD-1 | done | 0.48 | 71.3 | — | 587 | ◎ | Inventive Example |
| MD-2 | none | 0.12 | 54.1 | — | 101 | X | Comparative Example |
| MF-1 | done | 0.11 | 55.0 | — | 172 | X | " |
| MF-2 | none | 0.02 | 57.0 | — | 101 | X | " |
| MG-1 | done | 0.42 | 81.0 | — | 298 | ◎ | Inventive Example |
| MH-1 | done | 0.49 | 79.1 | — | 442 | ◎ | " |
| MI-1 | done | 0.51 | 88.1 | — | 487 | ◎ | " |
| MJ-1 | done | 0.33 | 73.1 | — | 351 | ◎ | " |
| MK-1 | done | 0.34 | 68.9 | — | 512 | ◎ | " |
| ML-1 | — | | (unable of hot-rolling) | | | | Comparative Example |
| MM-1 | done | 0.33 | 51.2 | — | 422 | ◎ | Inventive Example |
| MN-1 | done | 0.56 | 58.9 | — | 678 | ◎ | " |
| MO-1 | done | 0.51 | — | 60.1 | 542 | ◎ | " |
| MP-1 | done | 0.28 | 67.8 | — | 333 | ◎ | " |
| MQ-1 | done | 0.44 | 89.0 | — | 612 | ◎ | " |
| MR-1 | done | 0.54 | 83.2 | — | 289 | ◎ | " |
| MS-1 | done | 0.49 | 54.4 | — | 412 | ◎ | " |
| MT-1 | none | — | — | — | 180 | ○ | " |

Aging 9 hours at 790° C.

EXAMPLE 6

Test pieces were sampled from Steel MC in Table 7 under the same conditions as Example 5. Test pieces were individually subjected to aging treatment under conditions varied within ranges of 450–950° C. and 0.5–16 hours. Machinability of each aged test piece was evaluated in the same way as Example 5.

It is understood from results shown in Table 9 that any of test pieces MC-4 and MC-6 to MC-10, which was aged one hour or longer at 500–900° C., had Cu-enriched particles with concentration of Sn of 10 mass % or more dispersed in a steel matrix at a ratio of 0.2 vol. % or more, resulting in good machinability.

On the other hand, Steel MC-5, which was aged at a temperature within a range of 500–900° C. but for a time shorter than one hour, was poor of machinability due to the structure that Cu-enriched particles were insufficiently dispersed at a ratio less than 0.2 vol. %. A precipitation ratio of Cu-enriched particles was also less than 0.2 vol. % at an aging temperature lower than 500° C. or higher than 900° C.

The results prove that important factors for improvement of machinability are Cu content of 0.5 mass % or more in a stainless steel and a ratio of Cu-enriched particles with concentration of Sn or In of 10 mass % or more dispersed at a ratio of 0.2 vol. % or more in a martensitic matrix, and that the proper precipitation ratio of Cu-enriched particles is realized by aging the stainless steel at 500–900° C. for one hour or longer.

TABLE 9

Relationship of Aging Conditions with Precipitation of Cu-enriched Particles and Machinability

| | Aging conditions | | Cu-enriched Particles | | | | |
|---|---|---|---|---|---|---|---|
| Steel Kind | Temperature (° C.) | Heating hours | Precipitation ratio (vol. %) | Concentration of Sn (mass %) | Wear-out period (minutes) of bits | Machinability | Note |
| MC-3 | 450 | 12 | 0.11 | 24.3 | 145 | X | Comparative Example |
| MC-4 | 500 | 7 | 0.34 | 55.1 | 455 | ◎ | Inventive Example |
| MC-5 | 500 | 0.5 | 0.12 | 48.3 | 171 | X | Comparative Example |
| MC-6 | 500 | 1 | 0.21 | 59.1 | 501 | ◎ | Inventive Example |
| MC-7 | 600 | 10 | 0.39 | 62.1 | 498 | ◎ | " |
| MC-8 | 700 | 12 | 0.42 | 71.9 | 389 | ◎ | " |
| MC-9 | 800 | 8 | 0.44 | 72.1 | 442 | ◎ | " |
| MC-10 | 900 | 16 | 0.45 | 73.1 | 352 | ◎ | " |
| MC-11 | 950 | 9 | 0.19 | 71.1 | 127 | X | Comparative Example |

EXAMPLE 7

Several ferritic stainless steels with chemical compositions shown in Table 10 were melted in a 30 kg-vacuum melting furnace, cast to slabs, heated one hour at 1230° C., hot-rolled to thickness of 4 mm, aged at various temperatures and then pickled.

Each steel sheet was subjected to the same machining test as Example 5 with a horizontal milling machine. Machinability of each test piece was evaluated by a machining period until the bits were worn out by 0.1 mm.

Another test piece sampled from the same steel sheet was observed by TEM, and Cu-enriched particles dispersed in a steel matrix was quantitatively analyzed by an image processor to calculate a ratio (vol. %) of the Cu-enriched particles. Furthermore, concentration of Sn or In in the Cu-enriched particles was measured by EDX.

TABLE 10

Chemical Compositions of Ferritic Stainless Steels

| Steel | Alloying Elements (mass %) | | | | | | | | |
|---|---|---|---|---|---|---|---|---|---|
| Kind | C | Si | Mn | S | Ni | Cr | Cu | Sn | Others |
| FA | 0.054 | 0.56 | 0.34 | 0.002 | 0.23 | 16.25 | 2.02 | 0.003 | |
| FB | 0.058 | 0.42 | 0.52 | 0.003 | 0.33 | 16.01 | 1.88 | 0.007 | |
| FC | 0.045 | 0.31 | 0.34 | 0.012 | 0.21 | 17.21 | 1.51 | 0.101 | |
| FE | 0.033 | 0.29 | 0.12 | 0.007 | 0.42 | 17.33 | 0.48 | 0.112 | |
| FF | 0.021 | 0.21 | 0.33 | 0.142 | 0.25 | 16.98 | 1.44 | 0.198 | |
| FG | 0.009 | 0.31 | 0.2 | 0.005 | 0.26 | 17.02 | 1.46 | 0.098 | Nb: 0.32 |
| FH | 0.021 | 0.41 | 0.23 | 0.007 | 0.42 | 16.53 | 2.43 | 0.132 | Ti: 0.28 |
| FI | 0.061 | 0.55 | 0.42 | 0.004 | 0.12 | 16.31 | 1.34 | 0.121 | Al: 0.06 |
| FJ | 0.001 | 0.31 | 0.34 | 0.012 | 0.21 | 17.21 | 1.21 | 0.098 | Zr: 0.45 |
| FK | 0.003 | 0.21 | 0.12 | 0.011 | 0.33 | 16.91 | 1.01 | 0.143 | In: 0.12 |
| FL | 0.021 | 0.18 | 0.41 | 0.009 | 0.54 | 16.43 | 1.98 | 0.221 | B: 0.009 |

TABLE 10-continued

Chemical Compositions of Ferritic Stainless Steels

| Steel | Alloying Elements (mass %) | | | | | | | | |
|---|---|---|---|---|---|---|---|---|---|
| Kind | C | Si | Mn | S | Ni | Cr | Cu | Sn | Others |
| FM | 0.009 | 0.13 | 0.22 | 0.003 | 0.11 | 17.21 | 0.98 | 0.329 | REM: 0.015 |
| FN | 0.041 | 0.23 | 0.22 | 0.278 | 0.12 | 17.33 | 0.12 | 0.002 | |

Machinability of each test piece, which were sampled from Steels FA-1 to FT-1 aged 9 hours at 820° C., was compared with machinability of Steel FN-1, which has been regarded heretofore as material good of machinability. The mark ◎ means machinability better than Steel FN-1, the mark ○ means machinability similar to Steel FN-1, and the mark X means inferior machinability to Steel FN-1. Results of machinability are shown in Table 11.

Any of Steels FB-1, FC-1, FF-1, FG-1, FH-1, FI-1, FJ-1, FK-1, FL-1 and FM-1, which contained Cu not less than 0.5 mass % and Sn (or In in Steel FK-1) not less than 0.005 mass % and had the structure that Cu-enriched particles with concentration of Sn or In not less than 10 mass % were dispersed in a steel matrix at a ratio of 0.2 vol. % or more by aging-treatment, was excellent in machinability.

On the other hand, Steels FB-2, FC-2 and FE-2, which were not subjected to aging treatment, had Cu-enriched particles dispersed at an insufficient ratio less than 0.2 vol. % regardless Cu content more than 0.5 mass %, resulting in poor machinability. Steels FE-1 and -2 were poor of machinability due to shortage of Cu for dispersion of Cu-enriched particles at a ratio of 0.2 vol. % or more after aging treatment. Steel FA-1 had inferior machinability due to shortage of Sn for concentration of Sn not less than 10 mass % in Cu-enriched particles. Steel FD-1, which contained Sn more than 0.15 mass % on the contrary, was too poor of hot-workability to prepare a test piece for evaluation.

EXAMPLE 8

Test pieces were sampled from Steel FC in Table 10 under the same conditions as Example 7. Test pieces were individually subjected to aging treatment under conditions varied within ranges of 450–950° C. and 0.5–11 hours. Machinability of each aged test piece was evaluated in the same way as Example 7.

It is understood from results shown in Table 12 that any of test pieces FC-4 and FC-6 to FC-10, which was aged one hour or longer at 500–900° C., had Cu-enriched particles with concentration of Sn of 10 mass % or more dispersed in a steel matrix at a ratio of 0.2 vol. % or more, resulting in good machinability.

On the other hand, Steel FC-5, which was aged at a temperature within a range of 500–900° C. but for a period shorter than one hour, was poor of machinability due to the structure that Cu-enriched particles with concentration of Sn not less than 10 mass % were insufficiently dispersed at a ratio less than 0.2 vol. A precipitation ratio of Cu-enriched particles was also less than 0.2 vol. % at an aging temperature lower than 500° C. or higher than 900° C.

The results prove that important factors for improvement of machinability are Cu content not less than 0.5 mass % in a ferrite matrix and a ratio of Cu-enriched particles with concentration of Sn or In of 10 mass % or more dispersed at a ratio of 0.2 Vol. % or more in a steel matrix, and that the

TABLE 11

Effects of Cu-enriched Particles on Machinability

| Steel | | Cu-enriched particles | | | | | |
|---|---|---|---|---|---|---|---|
| | | Precipitation | Concentration (mass %) | | Worn-out period | | |
| Kind | Aging | ratio (vol. %) | Sn | In | (minutes) of bits | Machinability | Note |
| FA-1 | done | 0.32 | 5.2 | — | 192 | ◎ | Prior Art |
| FA-2 | none | 0.14 | 5.4 | — | 121 | X | Comparative Example |
| FB-1 | done | 0.33 | 12.3 | — | 289 | ◎ | Inventive Example |
| FB-2 | none | 0.08 | 10.5 | — | 110 | X | Comparative Example |
| FC-1 | done | 0.38 | 43.7 | — | 487 | ◎ | Inventive Example |
| FC-2 | none | 0.04 | 42.1 | — | 98 | X | Comparative Example |
| FE-1 | none | 0.18 | 35.2 | — | 151 | X | Inventive Example |
| FE-2 | — | 0.02 | 37.1 | — | 122 | X | Comparative Example |
| FF-1 | done | 0.34 | 81.0 | — | 501 | ◎ | Inventive Example |
| FG-1 | done | 0.51 | 77.0 | — | 332 | ◎ | Inventive Example |
| FH-1 | done | 0.28 | 62.1 | — | 391 | ◎ | " |
| FI-1 | done | 0.39 | 68.4 | — | 444 | ◎ | " |
| FJ-1 | done | 0.41 | 51.2 | — | 298 | ◎ | " |
| FK-1 | done | 0.27 | — | 71.2 | 401 | ◎ | " |
| FL-1 | done | 0.27 | 71.2 | — | 401 | ◎ | " |
| FM-1 | done | 0.51 | 78.8 | — | 476 | ◎ | " |
| FN-1 | none | — | — | — | 151 | ○ | Comparative Example |

Aging 10 hours at 820° C.

proper precipitation ratio of Cu-enriched particles is realized by aging the stainless steel at 500–900° C. for one hour or longer.

TABLE 12

Relationship of Aging Conditions with Precipitation of Cu-enriched Particles and Machinability

| Steel Kind | Aging conditions: Temperature (° C.) | Aging conditions: Heating hours | Cu-enriched Particles: Precipitation ratio (vol. %) | Cu-enriched Particles: Concentration of Sn (mass %) | Wear-out period (minutes) of bits | Machinability | Note |
|---|---|---|---|---|---|---|---|
| FC-3 | 450 | 8 | 0.11 | 52.3 | 125 | X | Prior Art |
| FC-4 | 500 | 8 | 0.32 | 57.4 | 177 | ◎ | Inventive Example |
| FC-5 | 500 | 0.5 | 0.17 | 49.8 | 131 | X | Comparative Example |
| FC-6 | 500 | 1 | 0.22 | 51.1 | 169 | ◎ | Inventive Example |
| FC-7 | 600 | 10 | 0.29 | 59.2 | 181 | ◎ | " |
| FC-8 | 700 | 9 | 0.44 | 50.1 | 192 | ◎ | " |
| FC-9 | 800 | 11 | 0.41 | 60.1 | 200 | ◎ | " |
| FC-10 | 900 | 9 | 0.42 | 55.5 | 202 | ◎ | " |
| FC-11 | 950 | 8 | 0.10 | 52.3 | 127 | X | Comparative Example |

INDUSTRIAL APPLICABILITY

Ferritic and martensite stainless steels proposed by the present invention as above-mentioned are good of machinability, due to chemical compositions containing 0.5 mass % or more of Cu and at least one of 0.001 mass % or more of C, 0.1 mass % or more of Sn and 0.1 mass % or more of In as well as the structure that Cu-enriched particles with concentration of C not less than 0.1 mass % or Sn or In not less than 10 mass % are dispersed at a ratio of 0.2 vol. % in a ferritic or martensitic matrix. There are no harmful effects on the environment, since the stainless steels do not contain such an element as S, Pb, Bi or Se for improvement of machinability. The stainless steels are machined to objective shapes and used as members for electric home appliance, furniture goods, kitchen equipment, machine, apparatus, and other equipment in various fields.

The invention claimed is:

1. A ferritic stainless steel having good machinability, comprising:

a chemical composition comprising 0.001–0.1 mass % of C, Si up to 1.0 mass %, Mn up to 1.0 mass %, 15–30 mass % of Cr, Ni up to 0.60 mass %, 0.5–6.0 mass % of Cu, one or more of Sn and In not less than 0.005 mass % in total, and the balance being Fe except inevitable impurities; and a structure having Cu-enriched particles with a concentration of Sn and/or In not less than 10 mass %, said particles being dispersed at 0.2 vol. % or more in a ferritic matrix.

2. A martensitic stainless steel having good machinability, comprising:

a chemical composition comprising 0.01–0.5 mass % of C, Si up to 1.0 mass %, Mn up to 1.0 mass %, 10–15 mass % of Cr, Ni up to 0.60 mass %, 0.5–6.0 mass % of Cu, one or more of Sn and In not less than 0.005 mass % in total, and the balance being Fe except inevitable impurities; and a structure having Cu-enriched particles with a concentration of Sn and/or In not less than 10 mass %, said particles being dispersed at 0.2 vol. % or more in a martensitic matrix.

3. The ferritic stainless steel defined by claim 1, wherein the composition further contains at least one or more of 0.2–1.0 mass % of Nb, 0.02–1 mass % of Ti, 0–3 mass % of Mo, 0–1 mass % of Zr, 0–1 mass % of Al, 0–1 mass % of V, 0–0.005 mass % of B and 0–0.05 mass % of rare earth metals (REM).

4. A method of manufacturing a ferritic or martensitic stainless steel sheet having good machinability, comprising the steps of:

providing a stainless steel comprising 0.001–0.5 mass % of C, Si up to 1.0 mass %, Mn up to 1.0 mass %, 10–30 mass % of Cr, Ni up to 0.60 mass %, 0.5–6.0 mass % of Cu, one or more of Sn and In not less than 0.005 mass % in total, and the balance being Fe except inevitable impurities; and aging said ferritic or martensite stainless steel at a temperature within a range of 500–900° C. for one hour or longer, at least one time after a hot-rolling step before a forming step to a final product, whereby Cu-enriched particles with a concentration of Sn and/or In not less than 10 mass % were dispersed in a ferritic or martensitic matrix by said aging.

5. The martensitic stainless steel defined by claim 2, wherein the composition further contains at least one or more of 0.2–1.0 mass % of Nb, 0.02–1 mass % of Ti, 0–3 mass % of Mo, 0–1 mass % of Zr, 0–1 mass % of Al, 0–1 mass % of V, 0–0.005 mass % of B and 0–0.05 mass % of rare earth metals (REM).

* * * * *